US009937546B2

(12) United States Patent
Urabe

(10) Patent No.: US 9,937,546 B2
(45) Date of Patent: Apr. 10, 2018

(54) PRESS FORMING METHOD

(71) Applicant: JFE STEEL CORPORATION, Tokyo (JP)

(72) Inventor: Masaki Urabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 372 days.

(21) Appl. No.: 14/443,744

(22) PCT Filed: Oct. 28, 2013

(86) PCT No.: PCT/JP2013/079132
§ 371 (c)(1),
(2) Date: May 19, 2015

(87) PCT Pub. No.: WO2014/097745
PCT Pub. Date: Jun. 26, 2014

(65) Prior Publication Data

US 2015/0298193 A1 Oct. 22, 2015

(30) Foreign Application Priority Data

Dec. 17, 2012 (JP) ..... 2012-274398

(51) Int. Cl.
*B21D 19/08* (2006.01)
*B21D 22/26* (2006.01)
(Continued)

(52) U.S. Cl.
CPC ..... *B21D 19/08* (2013.01); *B21D 22/26* (2013.01); *B21D 25/00* (2013.01); *B21D 5/04* (2013.01)

(58) Field of Classification Search
CPC ..... B21D 5/04; B21D 19/08; B21D 22/26; B21D 25/00
See application file for complete search history.

(56) References Cited

U.S. PATENT DOCUMENTS 2,235,090 A * 3/1941 Stall ..... B21D 19/08 126/211

FOREIGN PATENT DOCUMENTS

JP 2008-119736 A 5/2008
JP 2009-160655 A 7/2009
(Continued)

OTHER PUBLICATIONS

Jan. 21, 2014 International Search Report issued in International Patent Application No. PCT/JP2013/079132.
(Continued)

*Primary Examiner* — Teresa M Ekiert
(74) *Attorney, Agent, or Firm* — Oliff PLC

(57) ABSTRACT

A press forming method of press forming a formed part including a top portion having a concave outer edge with a part of the outer edge being concave inwards and a flange portion subjected to bending forming along the concave outer edge of the top portion includes: a first forming step of forming a preformed shape part including, in a part where the flange portion is formed in a blank material, a vertical wall portion that becomes a part of the flange portion and a mountain shaped portion that is bent outwards from the vertical wall portion and is convex towards the top portion; and a second forming step of forming the flange portion by performing bending forming on a part including the mountain shaped portion of the preformed shape part formed at the first forming step along a bending line that is a boundary from the vertical wall portion.

2 Claims, 16 Drawing Sheets

(51) Int. Cl.
*B21D 25/00* (2006.01)
*B21D 5/04* (2006.01)

(56) References Cited

FOREIGN PATENT DOCUMENTS

| | | | |
|---|---|---|---|
| JP | 2009-214118 | A | 9/2009 |
| JP | 2009-255167 | A | 11/2009 |

OTHER PUBLICATIONS

Steel Sheet Forming Technology Research Group Edition; Third Edition of Press Forming Difficulty Handbook; Nikkan Kogyo Shimbun, Ltd.; Mar. 30, 2007; p. 234, Table 4. 23.
Yohei Abe; "Improvement of stretch flangeability of high strength steel sheets by partial contacting punch;" Current Advances in Materials and Processes; 2008; vol. 21; p. 321.
Abe et al; "Improvement in stretch flangeability of ultra high strength steel sheets with punch having gradual contact;" Journal of JSTP; 2011; vol. 52; No. 604; pp. 569-573.
Nov. 17, 2015 Search Report issued in European Patent Application No. 13865147.6, pp. 1-4.

* cited by examiner

Conventional Art

PRESS FORMING METHOD

FIELD

The present invention relates to a press forming method of forming a stretch flange by press forming a metal sheet.

BACKGROUND

When a flange portion is formed by press forming a metal sheet between tools of press forming, stretch deformation (a stretch flange) may occur by a bent end portion of the flange portion of the metal sheet receiving a tensile force. Such forming is called "stretch flange forming". In stretch flange forming, if the stretch deformation exceeds the deformation limit of the metal sheet, a crack is generated. This crack is called "stretch flange crack". In particular, a stretch flange crack easily occurs in a formed part of a high-strength steel sheet, for example, a press formed part for an automobile. If a stretch flange crack is generated, a prescribed part shape may not be obtained.

As a method of avoiding such a stretch flange crack, for example, in Patent Literature 1, a method of suppressing generation of a stretch flange crack by improving a state of an end face of a part where a crack tends to be generated is disclosed. Further, in Patent Literature 2 and Non-Patent Literature 1, a method of giving excess metal by tools of press forming is described. Further, in Patent Literature 3 and Patent Literature 4, a method of using a blank shape in which a stretch flange crack is hard to be generated is disclosed. Further, in Non-Patent Literature 2 and Non-Patent Literature 3, a method of distributing deformation, suppressing centralization of the deformation at a stretch flange part, and avoiding generation of a stretch flange crack, by implementing forming using a sequential contacting punch is disclosed.

CITATION LIST

Patent Literature

Patent Literature 1: Japanese Patent Application Laid-open No. 2009-255167

Patent Literature 2: Japanese Patent Application Laid-open No. 2008-119736

Patent Literature 3: Japanese Patent Application Laid-open No. 2009-214118

Patent Literature 4: Japanese Patent Application Laid-open No. 2009-160655

Non-Patent Literature

Non-Patent Literature 1: Steel Sheet Forming Technology Research Group Edition "Third Edition of Press Forming Difficulty Handbook", Nikkan Kogyo Shimbun, Ltd., Mar. 30, 2007, p. 234, table 4. 23

Non-Patent Literature 2: Current Advances in Materials and Processes, 21 (2008), p. 321

Non-Patent Literature 3: Journal of The Japan Society for Technology of Plasticity, Vol. 52, No. 604, p. 569 to 573 (2011)

SUMMARY

Technical Problem

However, as disclosed in Patent Literature 1, effects of the method of improving the state of the end face of the part where a crack tends to be generated are limited, and the method does not lead to a fundamental solution to the problem of a stretch flange crack being generated. Further, as disclosed in Patent Literature 2 and Non-Patent Literature 1, effects of the method of giving the excess metal by the tools for press forming are similarly limited, and the method cannot be said as leading to a fundamental solution to the problem of a stretch flange crack being generated. Further, as disclosed in Patent Literature 3 and Patent Literature 4, as for the method of using the blank shape in which the stretch flange crack is hard to be generated, since the blank shape is restricted, freedom of product shape is reduced. Further, processing for adjusting the shape of the relevant part in order to obtain a targeted shape is ultimately required, also causing increase in cost. Further, as disclosed in Non-Patent Literature 2 and Non-Patent Literature 3, degradation in shape of the top portion has been identified in the case of using the sequential contacting punch, and there is a problem that application thereof is difficult when accuracy for the shape of the top portion is demanded.

The present invention has been made to solve the various problems as described above, and aims to provide a press forming method that fundamentally solves the problem of a stretch flange crack being generated, without decreasing the freedom of product shape, and that is excellent in accuracy for the shape of the top portion.

Solution to Problem

A press forming method according to the present invention is a press forming method of press forming a formed part including a top portion having a concave outer edge with a part of the outer edge being concave inwards and a flange portion subjected to bending forming along the concave outer edge of the top portion, and includes: a first forming step of forming a preformed shape part including, in a part where the flange portion is formed in a blank material, a vertical wall portion that becomes a part of the flange portion and a mountain shaped portion that is bent outwards from the vertical wall portion and is convex towards the top portion; and a second forming step of forming the flange portion by performing bending forming on a part including the mountain shaped portion of the preformed shape part formed at the first forming step along a bending line that is a boundary from the vertical wall portion.

In the above-described press forming method according to the present invention, the first forming step includes: holding a part of the blank material, the part becoming the top portion, between a pad and a first die; and Forming a part of the blank material, the part becoming the flange portion, by a first punch, and the second forming step includes: holding a part of the preformed shape part, the part becoming the top portion, between the pad and a second die; and forming the flange portion by a second punch that is along a shape including the mountain shaped portion of the preformed shape part.

Advantageous Effects of Invention

According to the present invention, a press forming method is able to be provided, the press forming method fundamentally solving the problem of a stretch flange crack being generated, without decreasing the freedom of product shape, and the press forming method being excellent in accuracy for the shape of the top portion (the top portion being hardly deformed).

DESCRIPTION OF EMBODIMENT

Hereinafter, with reference to the drawings, a press forming method according to an embodiment of the present invention will be described in detail. The present invention is not limited by this embodiment.

The inventors intensively studied for a fundamental solution for alleviating centralization of stretch at a bent end portion of a flange portion in stretch flange forming. As a result, the inventors supposed that when a flange portion is formed, if stretch and shrinkage occur simultaneously at a bent end portion of the flange portion, the stretch and shrinkage offset each other, and thus stretch does not centralize in the bent end portion and a crack is not generated in that part. A press forming method in which stretch and shrinkage occur simultaneously at a bent end portion of a flange portion was thus studied. Contents of this study will be described hereinafter, based on FIG. 21 to FIG. 25.

Figure 21A:
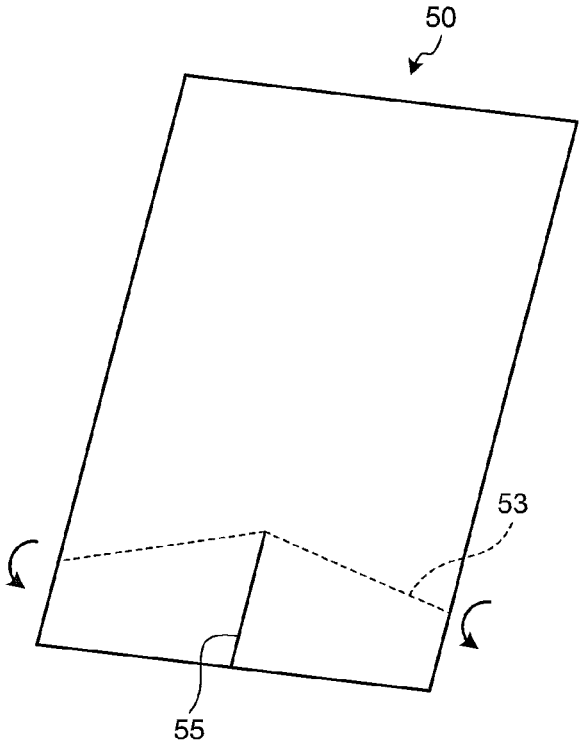
FIG. 21A is an explanatory diagram illustrating a mechanism of the press forming method according to the present invention.
Figure 21B:
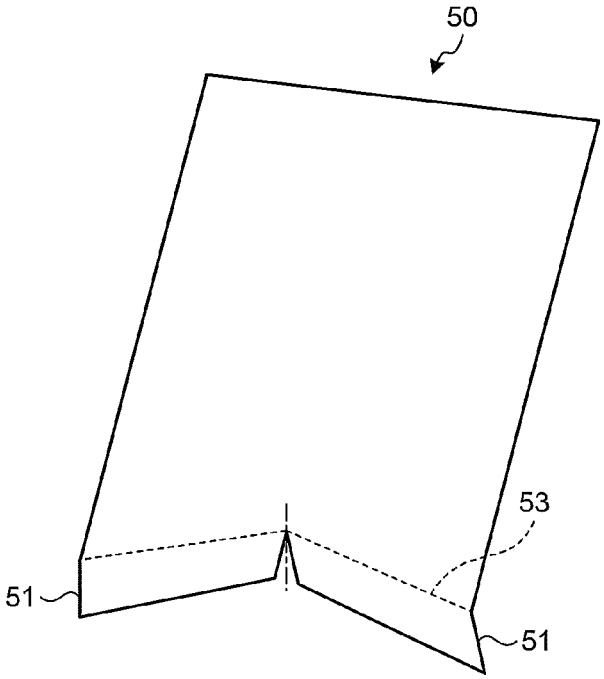
FIG. 21B is an explanatory diagram illustrating the mechanism of the press forming method according to the present invention.

FIG. 21A is a diagram illustrating a first blank 50, which is sheet-like. A broken line therein illustrates a first bending line 53 for forming a first flange portion 51 (see FIG. 21B) and a thick solid line in the middle illustrates a first incision 55. When the first flange portion 51 is formed by the first blank 50 being bent along the first bending line 53, as illustrated in FIG. 21B, a portion of the first incision 55 in the first flange portion 51 is opened. Thus, if the sheet does not have the first incision 55 and the sheet is continuous, stretch occurs at a part, illustrated with slanted lines in FIG. 22, in the first flange portion 51. This is stretch flange forming.

Figure 23A:
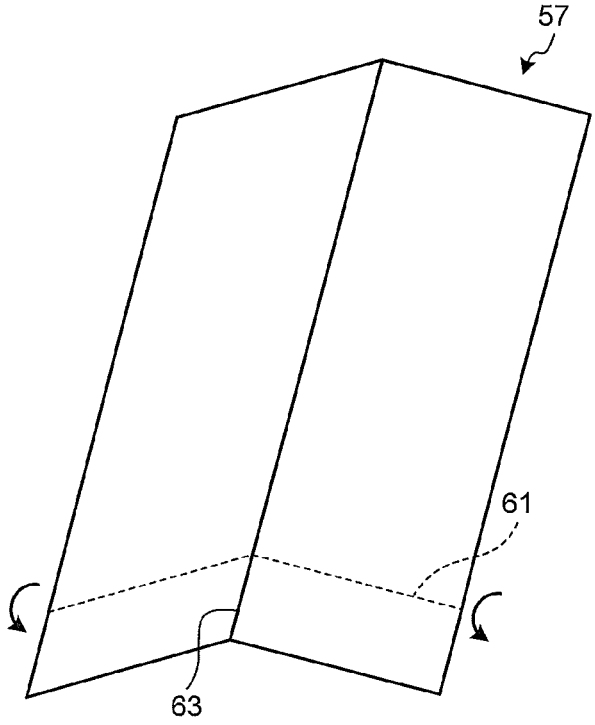
FIG. 23A is an explanatory diagram illustrating the mechanism of the press forming method according to the present invention.
Figure 23B:
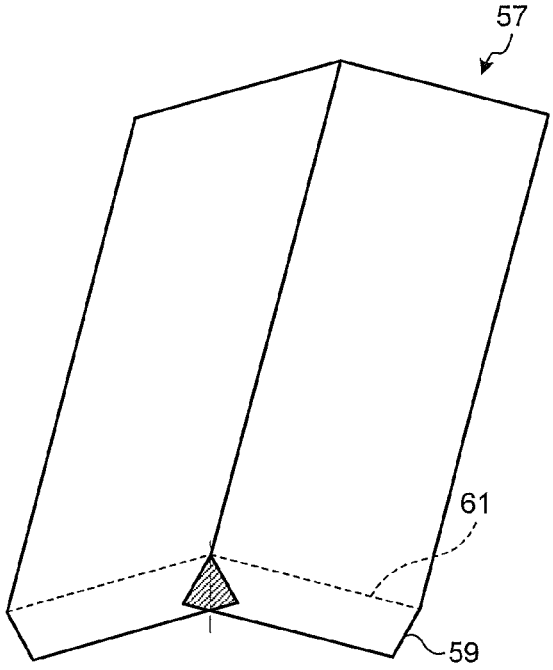
FIG. 23B is an explanatory diagram illustrating the mechanism of the press forming method according to the present invention.

FIG. 23A is a diagram illustrating a second blank 57 in which a rectangular sheet is mountain shaped in the middle thereof. A broken line therein illustrates a second bending line 61 for forming a second flange portion 59 and a thick solid line in the middle illustrates a second incision 63 placed in the sheet. When the second flange portion 59 is formed by the second blank 57 being bent along the second bending line 61, as illustrated in FIG. 23B, portions of the blank overlap each other at a central portion of the second flange portion 59. Therefore, if the sheet does not have the second incision 63 and the sheet is continuous, shrinkage occurs in a part, illustrated with slanted lines in FIG. 24, in the second flange portion 59, and if that shrinkage is not absorbed by increase in sheet thickness, wrinkles are generated. This is shrinkage flange forming.

Figure 22:
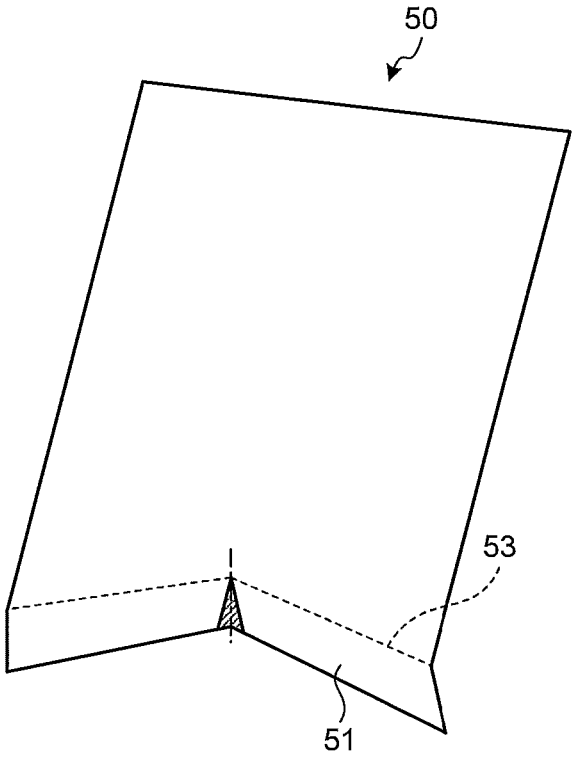
FIG. 22 is an explanatory diagram illustrating the mechanism of the press forming method according to the present invention.

As described above, when the first flange portion 51 is formed by the sheet-like first blank 50 being bent along the concave first bending line 53, where a part of an outer edge is concave inwards, as illustrated in FIG. 22, stretch occurs at the bent end portion of the first flange portion 51. Further, as illustrated in FIG. 24, if the second flange portion 59 is formed by the mountain shaped second blank 57 being bent along the bending line 61, which is along the mountain shape, shrinkage occurs in the bent end portion of the second flange portion 59.

Thus, by performing forming in which stretch and shrinkage occur simultaneously at the same portion of the flange portion as described above, the stretch and shrinkage offset each other. For that, the flange portion just needs to be formed by being bent along a bending line having the two characteristics of the concave first bending line 53, which is illustrated in FIG. 22 and is concave inwards, and of the second bending line 61, which is illustrated in FIG. 24 and is along the mountain shape.

For such forming to be performed, a preliminary preformed shape realizing the bending line having the two characteristics just needs to be made at a stage previous to forming of a flange portion of a targeted shape. FIG. 25 is a diagram illustrating an example of such a preformed shape. This preformed shape 65 is a shape including a top portion 69, a vertical wall portion 71, and a mountain shaped portion 73. The top portion 69 has a concave outer edge 67 with a part of the outer edge being concave inwards. The vertical wall portion 71 is formed into a part of a flange portion by being bent along the concave outer edge 67 of the top portion 69. The mountain shaped portion 73 is bent outwards from the vertical wall portion 71 and is convex towards the top portion 69. In the preformed shape 65 illustrated in FIG. 25, a third bending line 75 formed in the vertical wall portion 71 is a bending line having the above described two characteristics. That is, when viewed from above, since the preformed shape 65 is concave inwards, the third bending line 75 is shaped similarly to the first bending line 53 of FIG. 22. Further, when viewed from the front, since the preformed shape 65 is mountain shaped, the third bending line 75 is shaped similarly to the second bending line 61 of FIG. 24.

Figure 24:
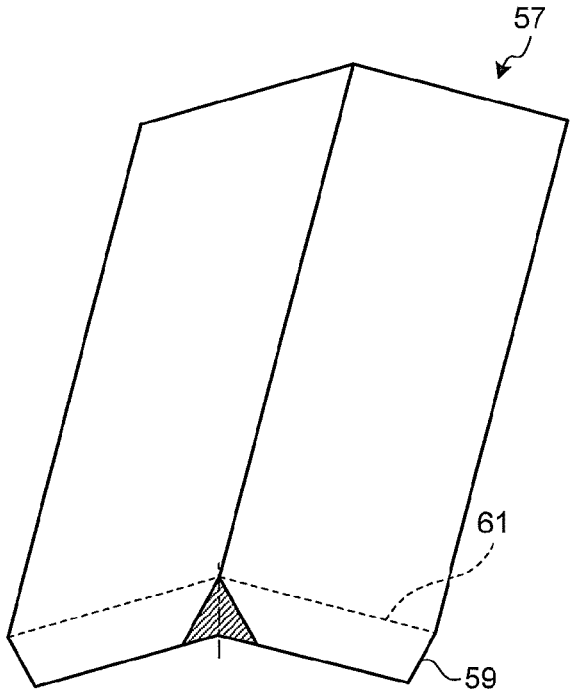
FIG. 24 is an explanatory diagram illustrating the mechanism of the press forming method according to the present invention.
Figure 25:
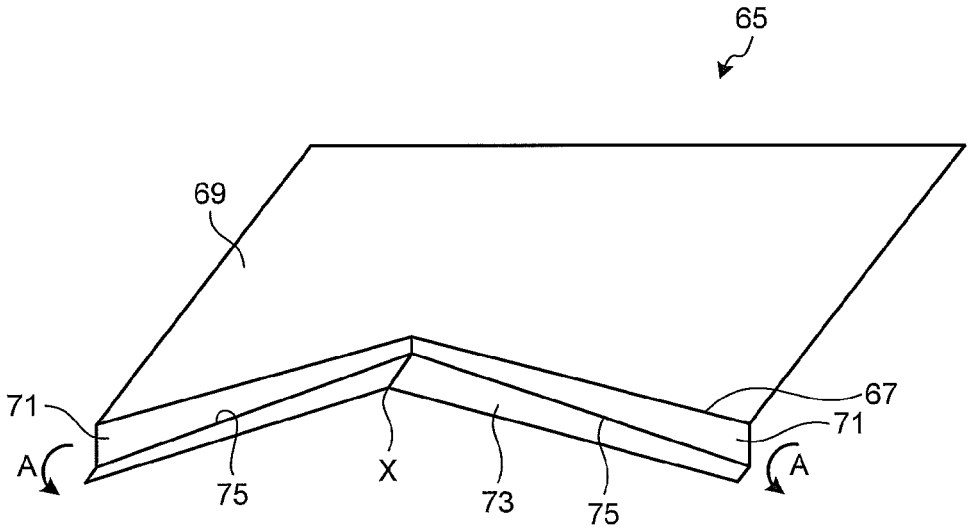
FIG. 25 is an explanatory diagram illustrating the mechanism of the press forming method according to the present invention.

When the preformed shape 65 is formed, and as illustrated with an arrow A in FIG. 25, the mountain shaped portion 73 is formed along the third bending line 75 of the vertical wall portion 71 appearing in this preformed shape 65; at an X-portion at a middle end of the mountain shaped portion 73, the stretch illustrated in FIG. 22 and the shrinkage illustrated in FIG. 24 occur simultaneously. As a result, the stretch and shrinkage offset each other, and a crack caused by the stretch, wrinkles caused by the shrinkage, and the like are not generated. Stretch occurs in the middle (concave portion of the concave shape) of the vertical wall portion 71 when the preformed shape 65 is formed, but since the hung down distance from the top portion 69 of that part is short, the magnitude of the stretch is not large and there is no problem of cracks and the like. The present invention has been made based on the above findings and specifically is formed as described below.

Figure 2:
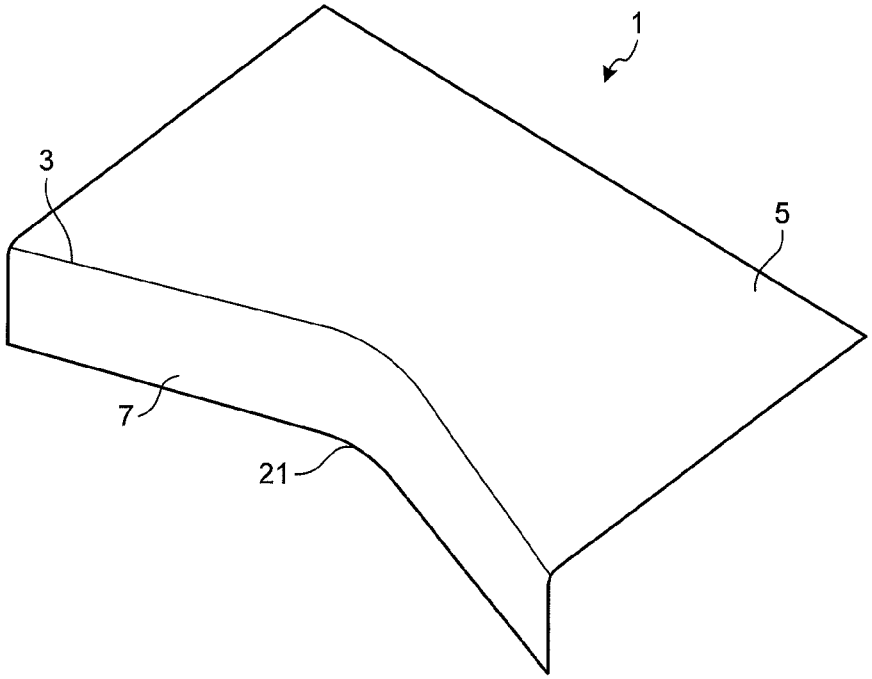
FIG. 2 is a diagram illustrating a formed part formed by the press forming method according to the embodiment of the present invention.

The press forming method according to the embodiment of the present invention is a press forming method of press forming a formed part 1 illustrated in FIG. 2. This formed part 1 has: a top portion 5 having a concave outer edge 3 with a part of the outer edge being concave inwards; and a flange portion 7 that is formed by being bent along the concave outer edge 3 of the top portion 5.

Figure 1A:
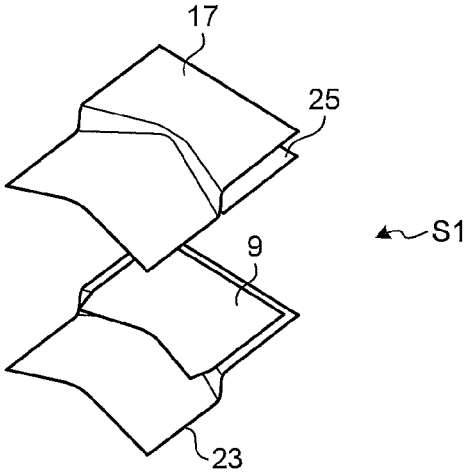
FIG. 1A is an explanatory diagram illustrating a first forming process of a press forming method according to an embodiment of the present invention.
Figure 1B:
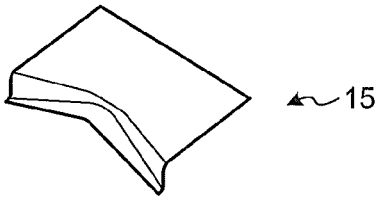
FIG. 1B is an explanatory diagram illustrating the first forming process of the press forming method according to the embodiment of the present invention.
Figure 1C:
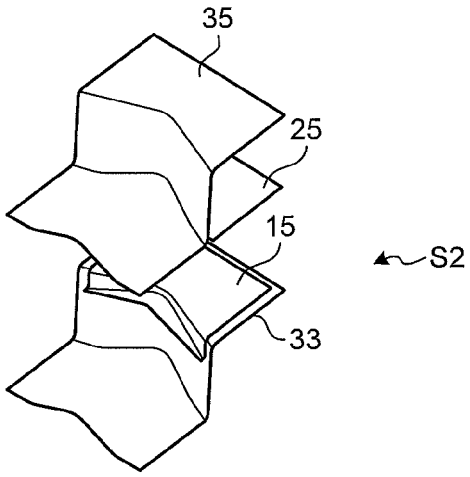
FIG. 1C is an explanatory diagram illustrating a second forming process of the press forming method according to the embodiment of the present invention.

The press forming method of this embodiment includes a first forming process S1 and a second forming process S2. In the first forming process S1, as illustrated in FIG. 1A, a preformed shape part 15 (see FIG. 1B and FIG. 3) is formed, which includes, in a part where the flange portion 7 is formed in a blank material 9, a vertical wall portion 11 that becomes a part of the flange portion 7 and a mountain shaped portion 13 that is bent outwards from the vertical wall portion 11 and is convex upwards. In the second forming process S2, as illustrated in FIG. 1C, a second punch 35 that is along a shape including the mountain shaped portion 13 of the preformed shape part 15 formed in the first forming process S1 forms the flange portion 7 by bending forming a part including the mountain shaped portion 13 along a boundary line 19 from the vertical wall portion 11 (see FIG. 1D). Hereinafter, the formed part 1, which is a targeted shape of the press forming method of this embodiment, the first forming process S1, and the second forming process S2 will be described in detail.

<Formed Part>

The formed part 1, which is the targeted shape of the press forming in this embodiment, has, as illustrated in FIG. 2, the top portion 5 having the concave outer edge 3 with the part of the outer edge being concave inwards, and the flange portion 7 formed by being bent along the concave outer edge 3 of the top portion 5. In the formed part 1 of such a shape, stretch centralizes in a bent end portion 21 of the flange portion 7 and a crack tends to be generated in that part.

<First Forming Process>

Figure 3:
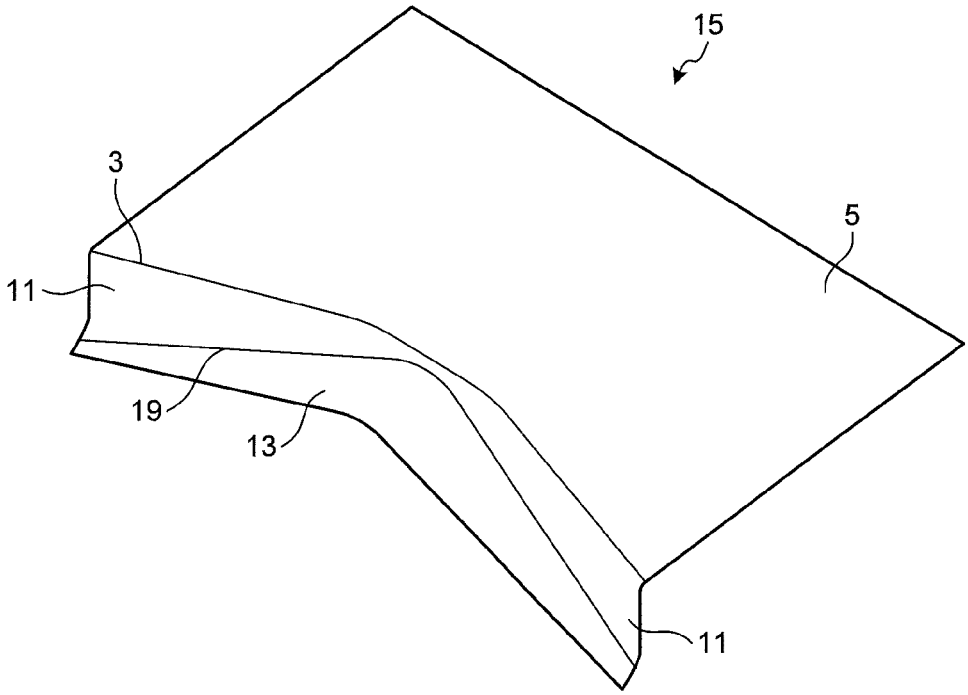
FIG. 3 is a diagram illustrating a preformed shape part formed by the first forming process of the press forming method according to the embodiment of the present invention.

The first forming process S1 of this embodiment is a process of forming the preformed shape part 15 (see FIG. 3). The preformed shape part 15 includes, at the part where the flange portion 7 is formed in the blank material 9, the vertical wall portion 11 that becomes the part of the flange portion 7 and the mountain shaped portion 13 that is bent outwards from the vertical wall and is convex upwards, that is, towards the top portion 5.

In the press forming of the first forming process S1, as illustrated in FIG. 1A, a first die 23, which is a bottom die of press forming, a first punch 17 that is lowered from above the die, and a pad 25 that presses the blank material 9 are used.

Figure 4A:
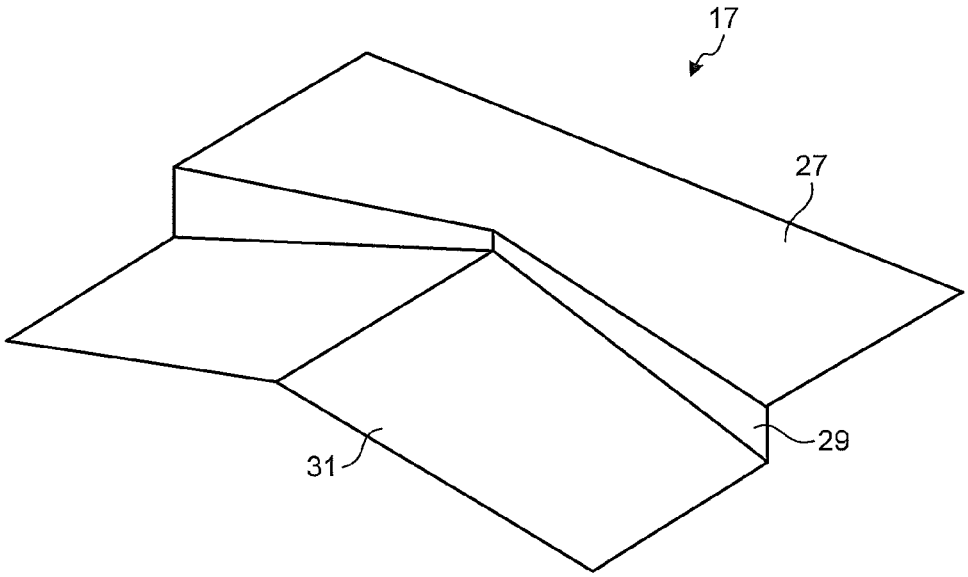
FIG. 4A is a diagram illustrating a first punch used in the first forming process of the press forming method according to the embodiment of the present invention.
Figure 4B:
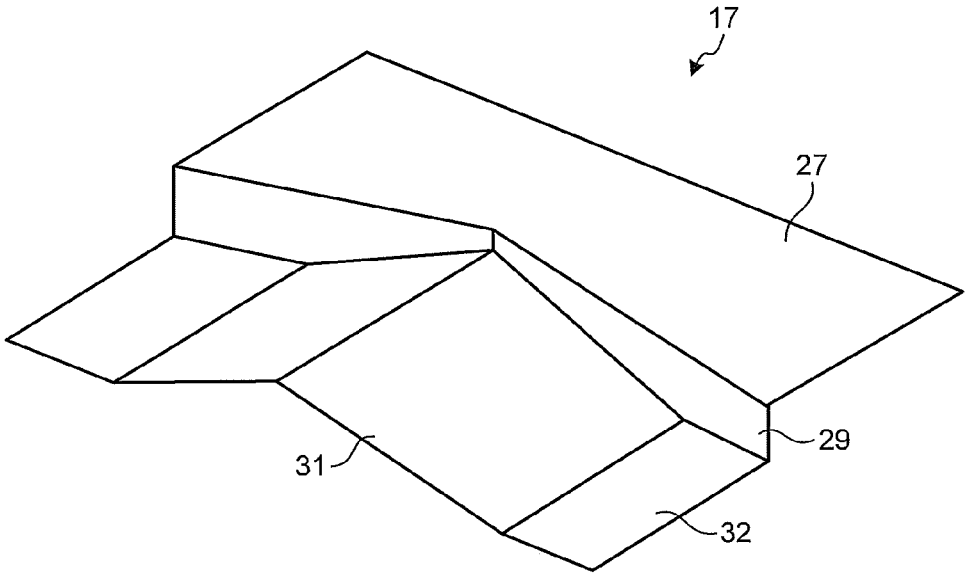
FIG. 4B is a diagram illustrating a first punch used in the first forming process of the press forming method according to the embodiment of the present invention.

The first punch 17 includes, as illustrated in FIG. 4A, a flat portion 27, a vertical wall forming portion 29, and a mountain shape forming portion 31. The flat portion 27 is positioned at a part corresponding to the top portion 5 of the formed part 1. The vertical wall forming portion 29 forms the vertical wall portion 11, which extends downwards along the concave outer edge 3 of the preformed shape part 15. The mountain shape forming portion 31 forms a mountain shape, which extends out in a horizontal direction from the vertical wall forming portion 29 and is convex upwards. The mountain shape forming portion 31 may have, as illustrated in FIG. 4B, a mountain shape base flat portion 32.

The first die 23 has a shape corresponding to shapes of respective forming portions of the first punch 17. A pressing force of the pad 25 pressing the blank material 9 onto the first die 23 is desirably a sufficiently strong force that does not cause deformation in the top portion 5 upon forming by lowering of the first punch 17.

The first forming process S1 will now be described more specifically. In the first forming process S1, as illustrated in FIG. 1A, in a state where the blank material 9 is held between the first die 23 and the pad 25, the first punch 17 is lowered towards the first die 23. As the first punch 17 is lowered, both ends of the mountain shape forming portion 31 (see FIG. 4) of the first punch 17 come into contact with the blank material 9, first. As the first punch 17 is lowered further, in order from a base of the blank material 9, the mountain shaped portion 13 and the vertical wall portion 11 are formed simultaneously.

Figure 5:
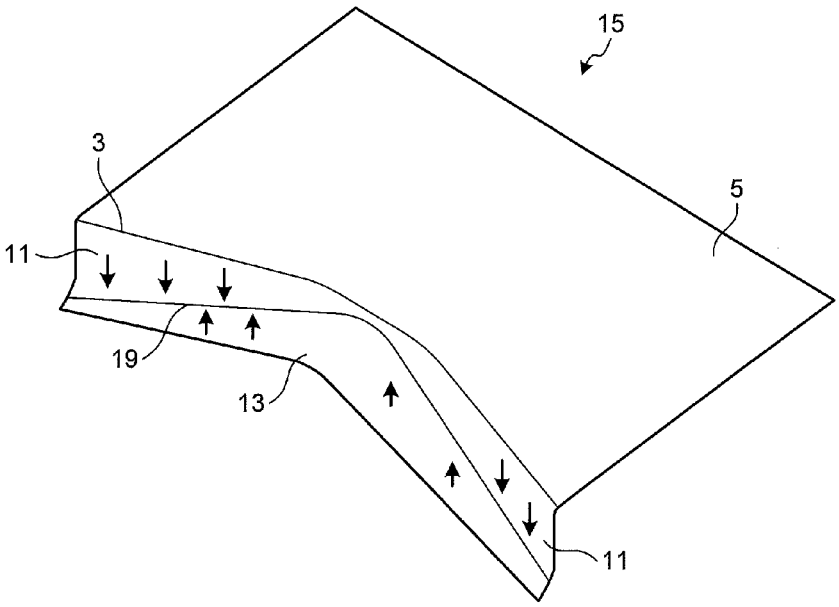
FIG. 5 is an explanatory diagram illustrating a mechanism of occurrence of sheared strain (plastic strain caused by sheared stress) caused in the first forming process of the press forming method according to the embodiment of the present invention.
Figure 6:
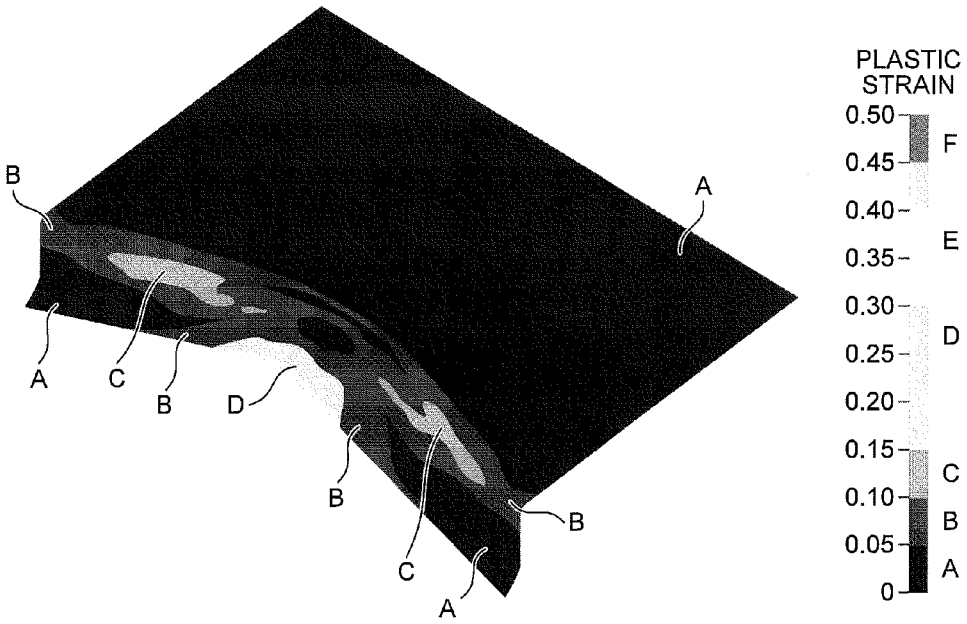
FIG. 6 is a diagram illustrating, with a distribution map, the plastic strain caused by the sheared stress in the first forming process of the press forming method according to the embodiment of the present invention.

As this happens, as illustrated with arrows in FIG. 5, the vertical wall portion 11 is pulled downwards and the mountain shaped portion 13 is pushed upwards, and thus, sheared stress acts between the vertical wall portion 11 and the mountain shaped portion 13. FIG. 6 is a distribution map illustrating plastic strain caused by this sheared stress in the first forming process S1. In FIG. 6, a part indicated with a symbol "A" is a part where the plastic strain is zero and in order of "B, C, D, E, and F", the plastic strain is increased.

As illustrated in FIG. 6, not only the mountain shaped portion 13 but also over a wide range of the vertical wall portion 11, the plastic strain is found to be caused. As a result, it is found that in the first forming process S1, the material over a wide range of the vertical wall portion 11 contributes to the forming of the mountain shaped portion 13 and that upon the forming of the mountain shaped portion 13, the plastic strain is distributed without being centralized.

Figure 7:
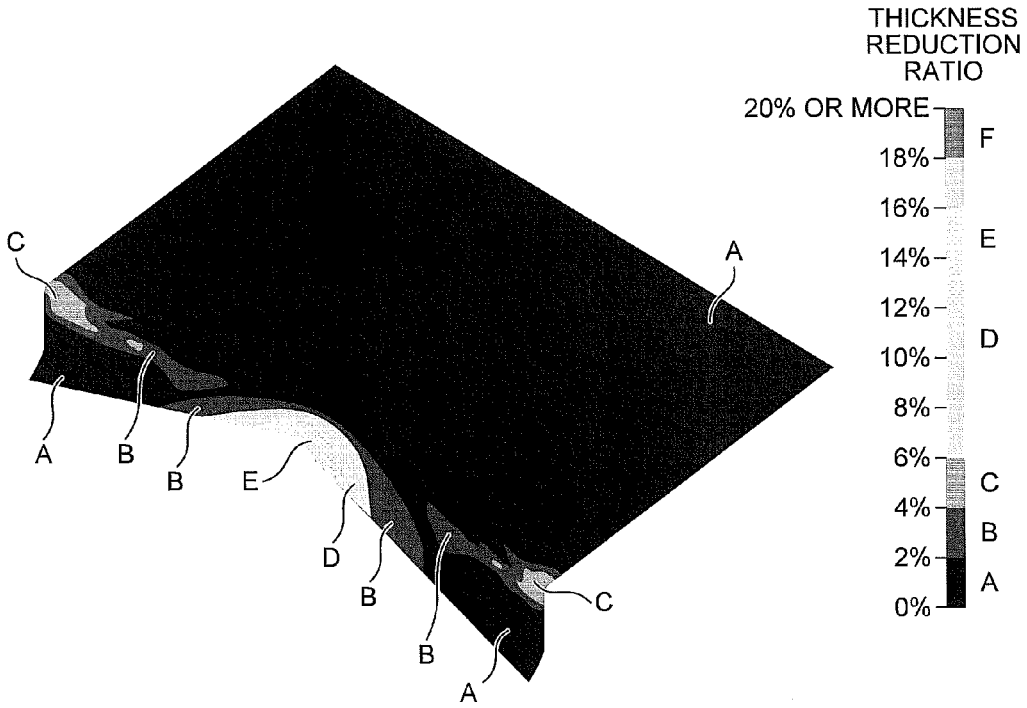
FIG. 7 is a diagram illustrating, with a distribution map, thickness reduction ratio in the first forming process of the press forming method according to the embodiment of the present invention.

FIG. 7 is a distribution map illustrating sheet thickness change after the first forming process S1 is implemented. In FIG. 7, a part indicated with the symbol A is a part where the thickness reduction ratio is zero and in order of "B, C, D, E, and F", the thickness reduction ratio is increased. As illustrated in FIG. 7, the thickness reduction ratio was 16% even in the vicinity of the top of the mountain shaped portion 13 where the thickness reduction ratio was the largest.

Accordingly, by the first forming process S1, without the plastic strain being centralized, the mountain shaped portion 13 is formed, and the boundary line 19 from the mountain shaped portion 13 is formed in the vertical wall portion 11 (see FIG. 3). This boundary line 19 has the same characteristics as those of the third bending line 75 illustrated in FIG. 25, that is, the characteristics of simultaneously causing the stretch and shrinkage at the bent end portion 21 of the flange portion 7.

In the first forming process S1, since sheared strain (plastic strain caused by the sheared stress) is caused at the part that becomes the flange portion 7, there is not much influence on the top portion 5 and no stress is caused on the top portion 5. Therefore, shape accuracy of flatness of the top portion 5 is kept high.

<Second Forming Process>

In the second forming process S2, as illustrated in FIG. 1C, a second die 33 and the pad 25 interpose the preformed shape part 15 formed by the first forming process S1 and the second punch 35 that is along the shape including the mountain shaped portion 13 bends a part including the mountain shaped portion 13 along the boundary line 19 downwards to form the flange portion 7.

Figure 8A:
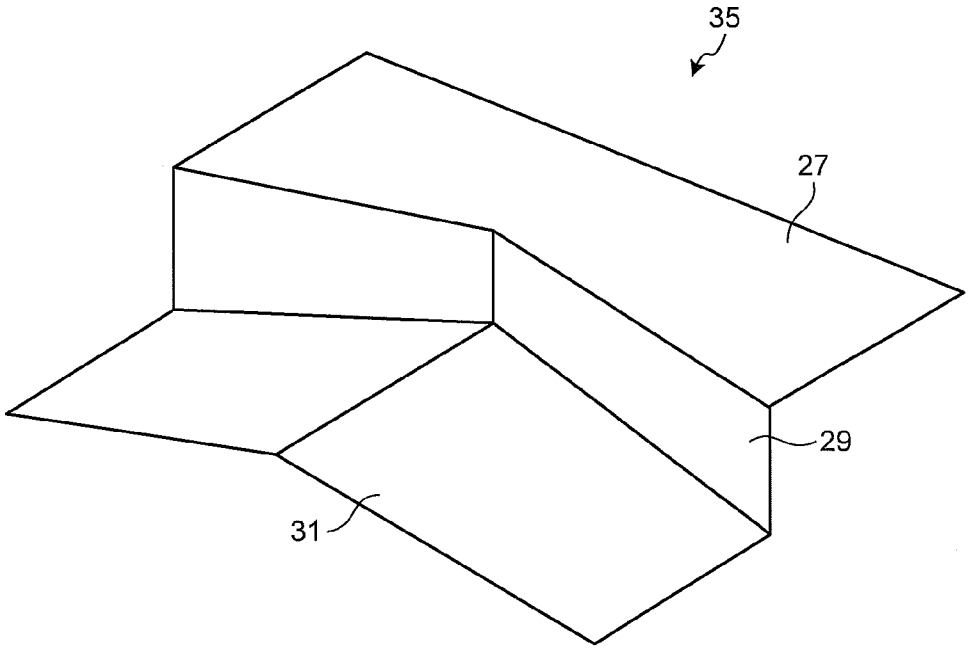
FIG. 8A is a diagram illustrating a second punch used in the second forming process of the press forming method according to the embodiment of the present invention.

The second punch 35 used in the second forming process S2 has, as illustrated in FIG. 8A, a concave shape that is along the mountain shaped portion 13 and a shape that is along the vertical wall portion 11, which are formed by the first forming process S1. The second punch 35 is different from the first punch 17 only in that the length of the vertical wall forming portion 29 is longer. The second die 33 has a shape corresponding to shapes of respective forming portions of the second punch 35.

Figure 1D:
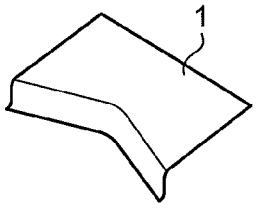
FIG. 1D is an explanatory diagram illustrating the second forming process of the press forming method according to the embodiment of the present invention.
Figure 8B:
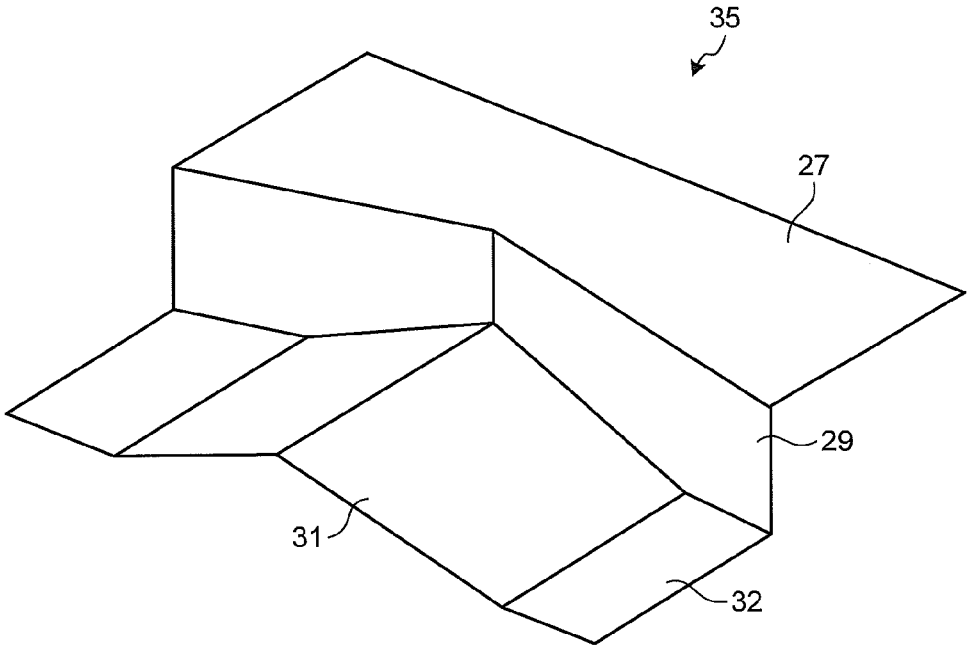
FIG. 8B is a diagram illustrating a second punch used in the second forming process of the press forming method according to the embodiment of the present invention.

When the second punch 35 as illustrated in FIG. 8A is lowered along the vertical wall portion 11 formed in the first forming process S1, the second punch 35 comes into contact with the shape including the mountain shaped portion 13. As the second punch 35 is lowered further, the shape including the mountain shaped portion 13 is subjected to bending forming vertically downwards from the boundary line 19 from the vertical wall portion 11 and as illustrated in FIG. 1D, the targeted shape is formed. The second punch 35 may have, as illustrated in FIG. 8B, the mountain shape base flat portion 32. Further, either of the combination of the second punch 35 of FIG. 8A or FIG. 8B and the first punch 17 of FIG. 4A or FIG. 4B may be used.

In this second forming process S2, the shape including the mountain shaped portion 13 formed in the first forming process S1 is subjected to bending forming downwards along the boundary line 19. When that is done, since both the stretch and shrinkage act on the central lower end portion of the flange portion 7 and offset each other, this bending forming does not cause large stretch and still more, does not cause any crack.

Figure 9:
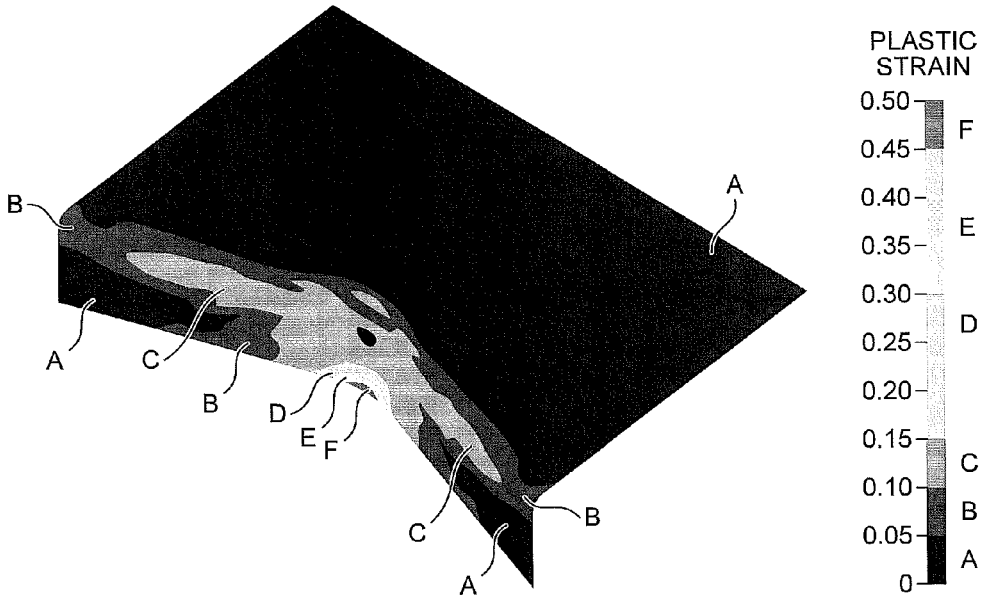
FIG. 9 is a diagram illustrating, with a distribution map, plastic strain caused by sheared stress in the second forming process of the press forming method according to the embodiment of the present invention.

FIG. 9 is a distribution map illustrating a distribution of the plastic strain after the second forming process S2. As illustrated in FIG. 9, the plastic strain is found to be distributed over a wide range. That is, by the plastic strain being distributed without being centralized, a crack is prevented from being generated. As illustrated in the distribution map of FIG. 9, some plastic strain is still caused at the bent end portion of the flange portion 7 even by the method of the present invention because the stretch and shrinkage occurring at that part do not match each other completely.

Figure 10:
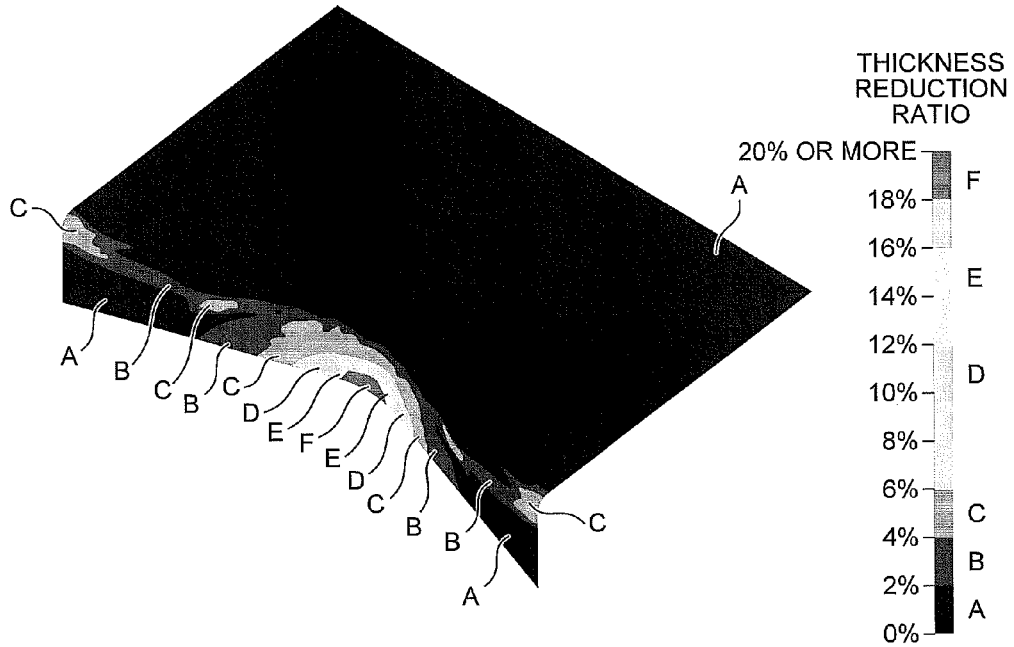
FIG. 10 is a diagram illustrating, with a distribution map, thickness reduction ratio in the second forming process of the press forming method according to the embodiment of the present invention.

FIG. 10 is a distribution map illustrating a distribution of sheet thickness after the second forming process S2. As illustrated in FIG. 10, the change in sheet thickness is dispersed over a wide range and the thickness reduction ratio was 20% even at a part where the thickness reduction ratio was the largest. This means that by the offset between the stretch and shrinkage, the largest value of the thickness reduction ratio is decreased and a crack is infallibly prevented from being generated.

Figure 11:
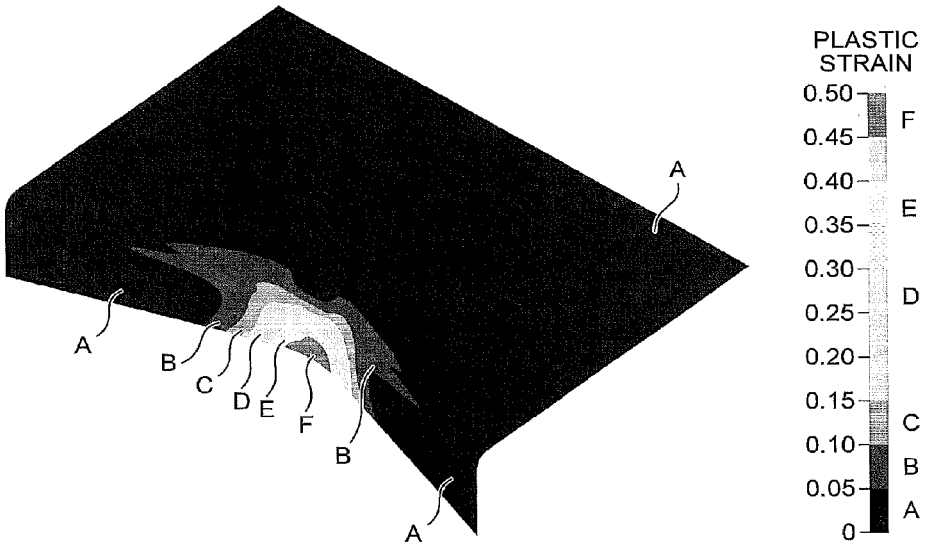
FIG. 11 is a diagram illustrating, with a distribution map, plastic strain caused by a conventional press forming method.
Figure 12:
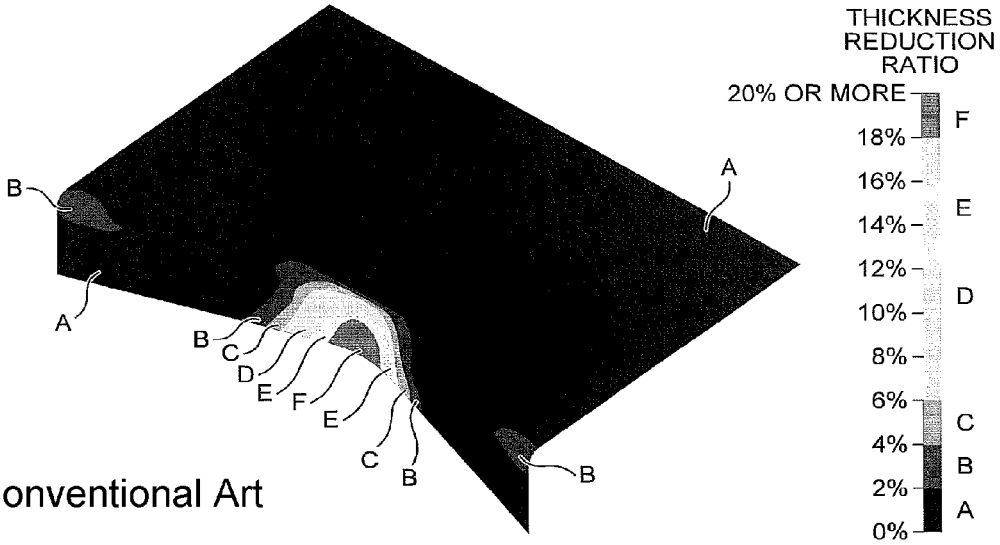
Conventional Art FIG.12
FIG. 12 is a diagram illustrating, with a distribution map, thickness reduction ratio when forming is implemented by the conventional press forming method.

FIG. 11 is a distribution map illustrating a plastic strain distribution when press forming is conducted by a conventional press forming method in which stretch flange forming is performed in a single process. Further, FIG. 12 is also a distribution map illustrating a distribution of sheet thickness when press forming is conducted by the conventional press forming method in which the stretch flange forming is performed in the single process. Comparing FIG. 11 with FIG. 9, in the conventional method (FIG. 11), contrary to FIG. 9 (the present invention), a part where plastic strain is caused is found to be not dispersed and found to be centralized in the bent portion at a central lower end of the flange portion 7. Further, comparing FIG. 12 with FIG. 10, in the conventional method (FIG. 12), contrary to FIG. 10 (the present invention), a part where sheet thickness change is caused is found to be not dispersed over a wide range of the flange portion 7 and found to be centralized in the middle. The largest thickness reduction ratio in the conventional method illustrated in FIG. 12 is 41% and is larger than 20% of the present invention illustrated in FIG. 10.

As described above, in this embodiment, the preformed shape part 15 is formed in the first forming process S1, the preformed shape part 15 including, at a part where the flange portion 7 is formed in the blank material, the vertical wall portion 11 that becomes a part of the flange portion 7 and a mountain shaped portion 13 that is bent outwards from the vertical wall portion 11 and that is convex towards the top portion 5. Next, in the second forming process S2, the part including the mountain shaped portion 13 of the preformed shape part 15 formed by the first forming process S1 is subjected to bending forming along the boundary line 19 from the vertical wall portion 11, and the flange portion 7 of the formed part 1 of the final shape is formed. Thereby, in the first forming process S1, the mountain shaped portion 13 is formed with the plastic strain being caused over a wide range of the flange portion 7 in the formed part 1, and as a result, centralization of the stretch is prevented and stretch deformation demanded in the bent end portion of the flange portion 7 is formed in advance. Further, the second forming process S2 is mainly bending forming and in the second forming process S2, since the stretch and shrinkage are caused simultaneously in the bent end portion of the flange portion 7 and the stretch is not centralized, stretch flange forming is able to be performed while effectively preventing a crack from occurring.

Further, the plastic strain upon forming the mountain shaped portion in the first forming process S1 is caused between the vertical wall portion 11 and the mountain shaped portion 13 that become the flange portion 7, and thus stress is hardly caused on the top portion 5, resulting in excellent shape accuracy of the top portion 5 (deformation of the top portion 5 being hardly caused).

[Working Examples]

Figure 13:
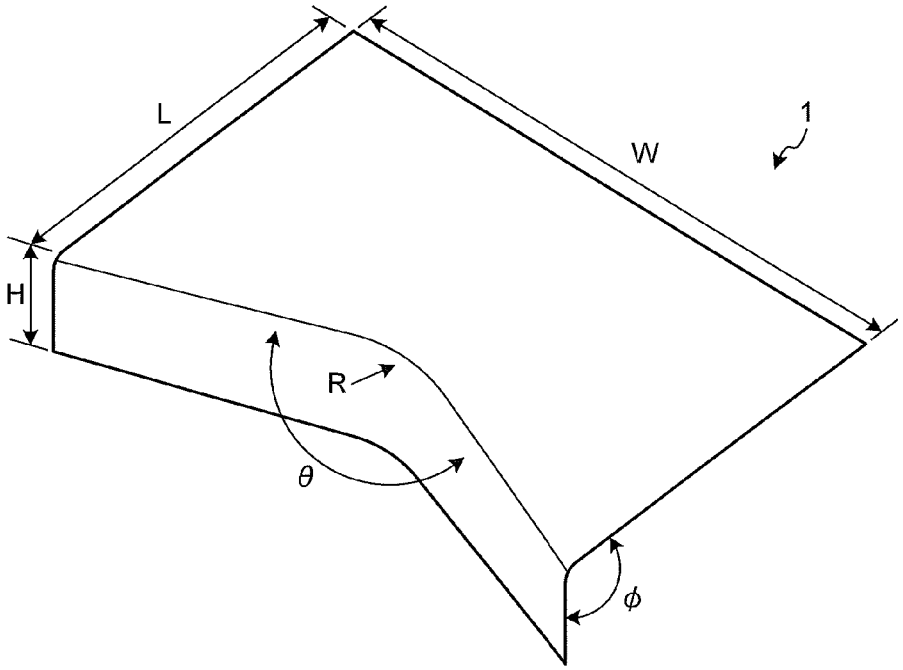
FIG. 13 is a diagram illustrating a formed part in a working example of the present invention.

In order to verify the effects of the present invention, the conventional method and the method of the present invention were tested by analysis according to a finite element method. Software used in the analysis was LS-DYNA, version 971, produced by LSTC and a dynamic explicit method was used. FIG. 13 is a diagram illustrating a shape of a formed part to be tested. Further, Table 1 is a table illustrating dimensions and the like of each portion of the formed part illustrated in FIG. 13. Two types of shape of the formed part were tested, one of them having a height H of a vertical wall portion of a flange portion of 30 mm (first shape of formed part) and the other one of them having a height H of the vertical wall portion of 40 mm (second shape of formed part). In Table 1, the unit of W, L, H, and R is "mm" and the unit of θ and φ is degree.

TABLE 1

| | W | L | H | θ | φ | R |
|---|---|---|---|---|---|---|
| First shape of formed part | 150 | 100 | 30 | 140 | 90 | 30 |
| Second shape of formed part | 150 | 100 | 40 | 140 | 90 | 30 |

Figure 14:
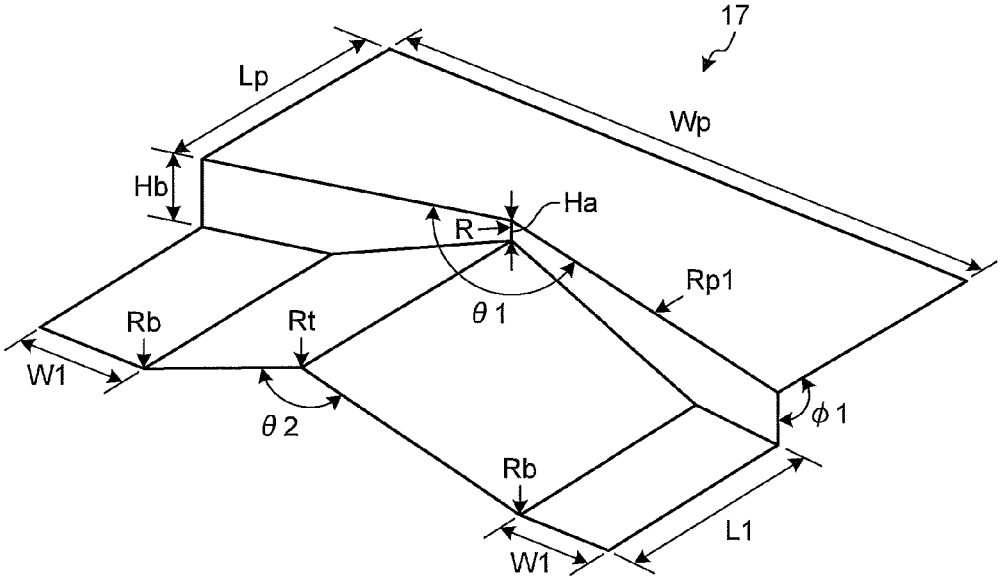
FIG. 14 is a diagram illustrating a first punch in the working example of the present invention.
Figure 15:
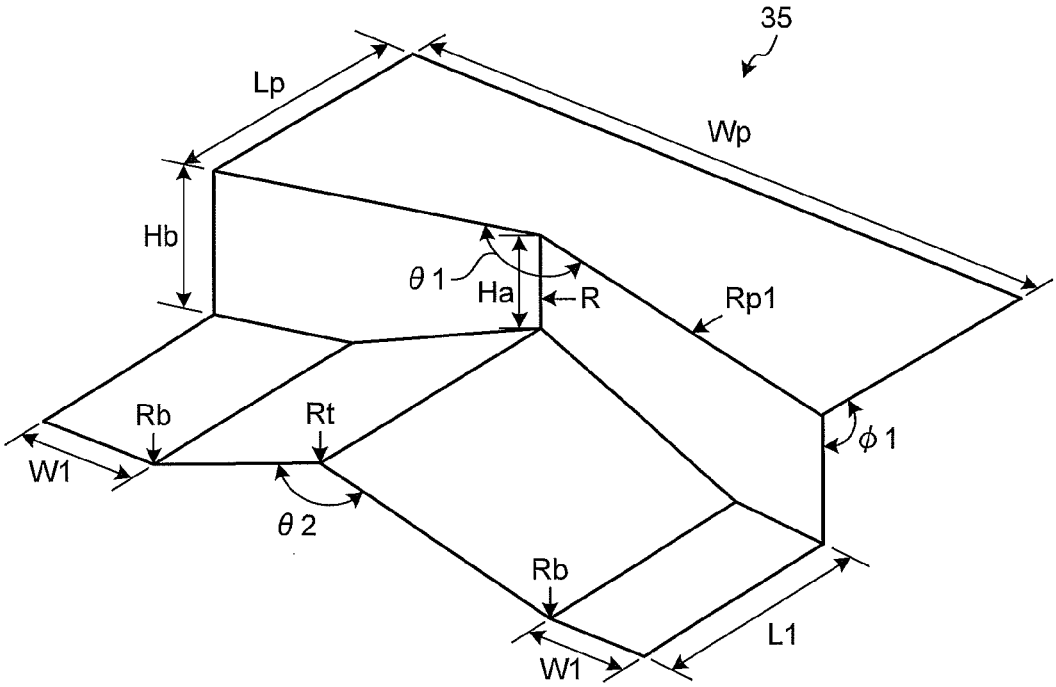
FIG. 15 is a diagram illustrating a second punch in the working example of the present invention.

Further, FIG. 14 is a diagram illustrating a first punch used in the first forming process of the present invention. Further, FIG. 15 is a diagram illustrating a second punch used in the second forming process. Further, Table 2 is a table illustrating dimensions and the like of each portion illustrated in FIG. 13 to FIG. 15. In Table 2, the unit of Wp, Lp, Ha, Hb, W1, L1, R, Rp1, Rt, and Rb is "mm" and the unit of θ1, θ2, and φ1 is degree. In Table 2, R, Rp1, Rt, and Rb represent radii of round processed portions.

TABLE 2

| | Wp | Lp | Ha | Hb | W1 | L1 | θ1 | θ2 | φ1 | R | Rp1 | Rt | Rb |
|---|---|---|---|---|---|---|---|---|---|---|---|---|---|
| First punch | 170 | 110 | 5 | 25 | 30 | 100 | 140 | 140 | 90 | 30 | 5 | 30 | 60 |
| Second punch | 170 | 110 | 72 | 90 | 30 | 100 | 140 | 140 | 90 | 30 | 5 | 30 | 60 |

Figure 16:
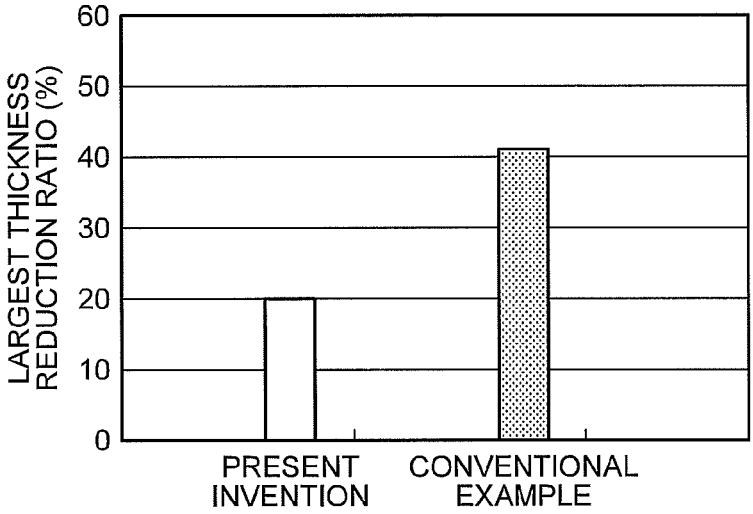
FIG. 16 is a graph illustrating effects of the working example of the present invention.
Figure 17:
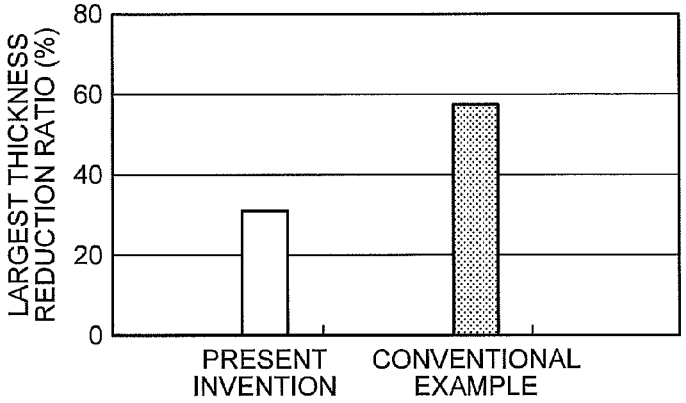
FIG. 17 is a graph illustrating effects of the working example of the present invention.

FIG. 16 compares between and graphically displays the largest thickness reduction ratios when the height H of the vertical wall portions of the flange portions is 30 mm for the present invention and the conventional example (the conventional press forming method in which stretch flange forming is conducted in a single process). Further, FIG. 17 compares between and graphically displays the largest thickness reduction ratios when the height H of the vertical wall portions of the flange portions is 40 mm for the present invention and the conventional example. As illustrated in FIG. 16, when the height H of the vertical wall portions was 30 mm, the largest thickness reduction ratio of the present invention was 20%, while the largest thickness reduction ratio in the conventional example was 41%. Further, as illustrated in FIG. 17, when the height H of the vertical wall portions was 40 mm, the largest thickness reduction ratio of the present invention was 31%, while the largest thickness reduction ratio in the conventional example was 58%. Accordingly, the press forming method of the present invention has been verified to be reduced in the largest thickness reduction ratio than the conventional method. This means that by the stretch flange forming by the press forming method of the present invention, a crack is effectively prevented from being generated.

Figure 18:
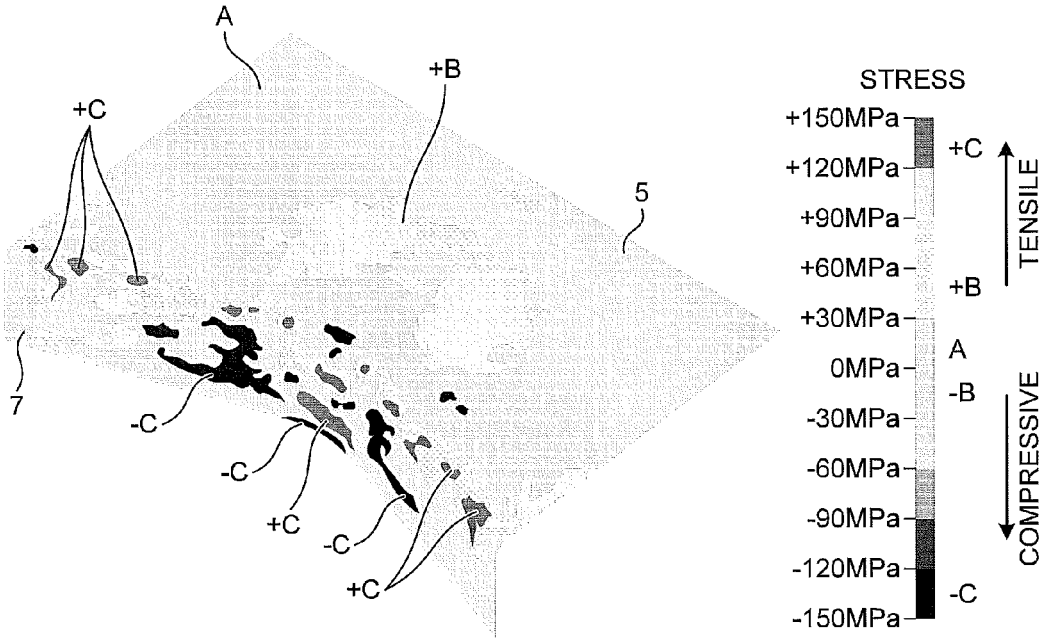
FIG. 18 is an explanatory diagram illustrating effects of the working example of the present invention and is a diagram illustrating, with a distribution map, a stress distribution in a formed part.

FIG. 18 is a distribution map illustrating a stress distribution of a blank before die release after implementation of the second forming process of the present invention. In FIG. 18, a part where the stress is zero is indicated with the symbol A and as the compressive stress is increased, illustration is made with −B, . . . , and −C and conversely as the tensile stress is increased, illustration is made with +B, . . . , and +C. As illustrated in FIG. 18, stress is found to be hardly caused on the top portion 5 and after the die release also, deformation of the top portion 5 is found to be hardly caused. This is supposed to be because in both forming processes of the first forming process S1 and the second forming process S2, the plastic strain is caused only in the flange portion 7. Therefore, it has been verified that even if accuracy in the shape of the top portion 5 is demanded also, the press forming method of the present invention is very useful.

In the above embodiment, a case where the shape of the top portion 5 of the formed part is flat has been described but the top portion of the formed part formed by the press forming method of the present invention does not need to be flat. For example, the top portion may be of a concave shape having a tilted surface tilting downward towards the middle, or inversely, the top portion may be of a convex shape having a tilted surface tilting upward towards the middle.

Figure 19:
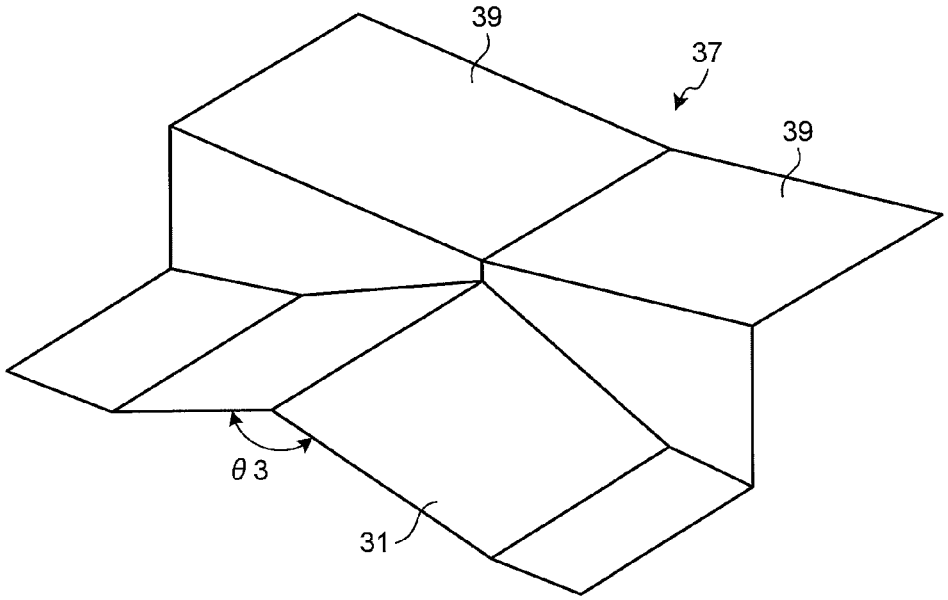
FIG. 19 is a diagram illustrating another mode of the first punch used in the first forming process in the press forming method of the present invention.
Figure 20:
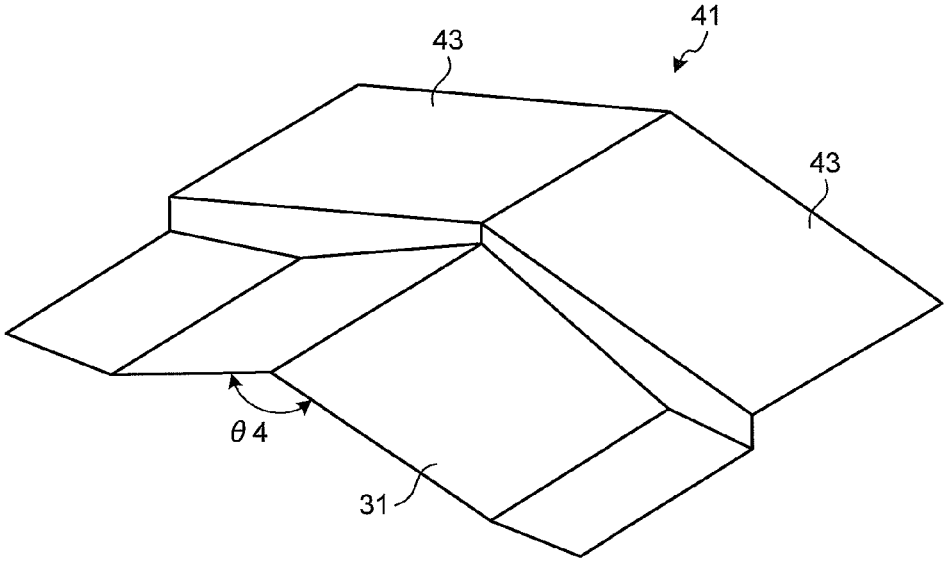
FIG. 20 is a diagram illustrating another mode of the first punch used in the first forming process in the press forming method of the present invention.

A top forming portion 39 of a first punch 37 when the top portion is concave shaped is, as illustrated in FIG. 19, of a concave shape formed of a tilted surface tilting downward towards the middle, and a tilt angle θ3 of the mountain shape forming portion 31 is desirably larger than a tilt angle θ2 for when the top portion is flat. Further, a top forming portion 43 of a first punch 41 when the top portion is convex shaped is, as illustrated in FIG. 20, of a convex shape formed of a tilted surface tilting upward towards the middle and a tilt angle θ4 of the mountain shape forming portion 31 desirably less than the tilt angle θ2 for when the top portion is flat.

INDUSTRIAL APPLICABILITY

The present invention is applicable to a process of forming a stretch flange by press forming a metal sheet. Accordingly, without decreasing the freedom of product shape, the problem of a stretch flange crack being generated is able to be fundamentally solved and a press forming process excellent in accuracy of the shape of the top portion is possible.

REFERENCE SIGNS LIST

S1 First forming process
S2 Second forming process
1 Formed part
3 Concave outer edge
5 Top portion
7 Flange portion
9 Blank material
11 Vertical wall portion
13 Mountain shaped portion
15 Preformed shape part
17 First punch
19 Boundary line
21 Bent end portion (flange central lower end portion)
23 First die
25 Pad
27 Flat portion
29 Vertical wall forming portion
31 Mountain shape forming portion
32 Mountain shape base flat portion
33 Second die
35 Second punch
37 First punch
39 Top forming portion
41 First punch
43 Top forming portion
50 First blank
51 First flange portion
53 First bending line
55 First incision
57 Second blank
59 Second flange portion
61 Second bending line
63 Second incision
65 Preformed shape
67 Concave outer edge
69 Top portion
71 Vertical wall portion
73 Mountain shaped portion
75 Third bending line

The invention claimed is:

1. A press forming method of press forming a formed part, the formed part comprising:

a top portion having an outer edge that forms a concave shape in plan view that extends inwardly with respect to the top portion, and a flange portion extending from the outer edge, the press forming method comprising:

a first forming step of forming a preformed shape part from a blank material, the preformed shape part including the top portion, a vertical wall portion, and a mountain shaped portion, the mountain shaped portion being bent outwards from the vertical wall portion and being convex towards the top portion, and the first forming step including holding a part of the blank material between a pad and a first die to form the top portion, and forming the vertical wall portion and the mountain shaped portion with a first punch; and a second forming step of forming the formed part from the preformed shape part, the second forming step including bending the mountain shaped portion along a bending line that is a boundary of the vertical wall portion to form the flange portion that extends from the outer edge, the bending line forming a boundary between the mountain shaped portion and the vertical wall portion, and the second forming step including holding the top portion between the pad and a second die, and forming the flange portion from the vertical wall portion and the mountain shaped portion with a second punch.

2. The press forming method according to claim 1, wherein the second forming step includes bending the mountain shaped portion downward and away from the top portion.

* * * * *